US005603567A

United States Patent [19]

Peacock

[11] Patent Number: 5,603,567

[45] Date of Patent: Feb. 18, 1997

[54] COAXIAL CRYOGENIC INJECTION SYSTEM

[75] Inventor: Richard Peacock, Healdsburg, Calif.

[73] Assignee: Blentech Corporation, Santa Rosa, Calif.

[21] Appl. No.: 670,239

[22] Filed: Jun. 17, 1996

Related U.S. Application Data

[63] Continuation of Ser. No. 390,622, Feb. 17, 1995, abandoned.

[51] Int. Cl.[6] ..... B01F 13/06; B01F 15/06; B01F 5/04; B01F 9/02

[52] U.S. Cl. ..... 366/139; 366/147; 366/175.3; 366/233

[58] Field of Search ..... 366/54, 56, 57, 366/59, 138, 139, 140, 167.1, 173.1, 175.1, 175.3, 220, 221, 225, 226, 227, 147, 233

[56] References Cited

U.S. PATENT DOCUMENTS

| | | | |
|---|---|---|---|
| 788,310 | 4/1905 | Fleming | 366/220 |
| 918,749 | 4/1909 | Hommel | 366/227 |
| 2,029,126 | 1/1936 | Rybeck | 366/59 |
| 2,264,180 | 11/1941 | Koehler | 366/220 |
| 2,628,080 | 2/1953 | Mack | 366/139 |
| 2,687,286 | 8/1954 | Eickstaedt | 366/59 |
| 2,697,637 | 12/1954 | Mittelstadt | 366/54 |
| 2,736,288 | 2/1956 | Clay | 366/220 |
| 2,893,216 | 7/1959 | Seefeldt et al. . | |
| 3,064,948 | 11/1962 | Hallberg | 366/225 |
| 3,565,168 | 2/1971 | Powell | 366/139 |
| 3,660,985 | 5/1972 | Tyree, Jr. . | |
| 3,906,743 | 9/1975 | Schorsch et al. . | |
| 3,992,985 | 11/1976 | McFarland . | |
| 4,187,325 | 2/1980 | Tyree, Jr. . | |
| 4,314,451 | 2/1982 | Leeds et al. . | |
| 4,476,686 | 10/1984 | Madsen et al. . | |
| 4,478,514 | 10/1984 | Hudelmaier | 366/59 |
| 4,501,499 | 2/1985 | Boan | 366/227 |
| 4,517,888 | 5/1985 | Gould | 366/139 |
| 4,640,099 | 2/1987 | Gibot . | |
| 5,104,232 | 4/1992 | Lennox, III . | |
| 5,376,175 | 12/1994 | Long, Jr. | 366/54 |

*Primary Examiner*—David Scherbel
*Assistant Examiner*—Randall E. Chin
*Attorney, Agent, or Firm*—Phillips, Moore, Lempio & Finley

[57] ABSTRACT

A vacuum tumble mixer is provided with a hollow drive shaft at one end thereof. The hollow drive shaft provides access by means of a probe to the cylindrical center section of the vacuum tumble mixer in order to inject the ingredients to be mixed, to introduce cooling material such as liquid nitrogen or carbon dioxide, and finally to permit cleaning fluids to be circulated about the interior of the tumbler while the tumbler is rotating. The use of the hollow shaft greatly improves the efficiency and operation of the tumbler for vacuum massaging and tumble chilling of meat, poultry, seafood and other products that are mixed at the commercial level.

14 Claims, 3 Drawing Sheets

COAXIAL CRYOGENIC INJECTION SYSTEM

This is a continuation of application Ser. No. 08/390,622 filed on Feb. 17, 1995, now abandoned.

BACKGROUND OF THE INVENTION

This invention relates to food mixing machines, and more particularly, to the access and chilling system for use in such machines.

Vacuum tumblers are large, cylindrical drums which are positioned with the cylinder access in a horizontal orientation or nearly horizontal orientation. Vacuum tumblers which are used to tumble massage meat, poultry and seafood products with a marinade are rotated about their axes. Integral with the tumbling process is the use of a vacuum to remove air in the meat and replace it with the associated marinade. Once the product is properly mixed, an additional and important use of the tumbler is to chill the product down to or near the freezing point of the meat cells in order to stiffen the meat so that it will retain a formed shape for cooking.

Vacuum tumblers of the type disclosed herein are similar to that disclosed in U.S. Pat. No. 5,104,232, which is assigned to the assignee of this invention. Such tumblers as described in the aforesaid patent may be designed with doors at one or both ends. The two-door version uses one of the doors for loading and the other for unloading. The one-door tumbler generally has a drum drive shaft welded or affixed at the end opposite the single door. The two-door tumbler is supported by drive wheels which rotate the drum by friction. Similar idler type wheels may be utilized in the axially driven drums in order to support the weight of the rotating drum.

A major use for vacuum tumblers is to chill the product for forming into shapes such as nuggets or patties before cooking. In order to make the meat stiff enough to form meat shapes out of small pieces of chicken, beef, or pork, it is necessary to chill down the meat so that thirty to forty percent of the meat cells are frozen. This is generally done by spraying a liquid cryogenic material such as liquid nitrogen or liquid carbon dioxide onto the meat. Utilizing this conventional system, the process chills down the drum, causing condensed water and frost to form on the outside of the drum. In the case of drive wheel drums, the slippery drum surface makes rotating the drum by friction very inefficient. Generally speaking, tumblers that are designed for chilling are direct-driven through a welded-on drive shaft and associated gearing or chain drive. These chilling tumblers are therefore restricted to having only one door.

In the one-door version, all the ingredients and additives must enter the single door to the vacuum tumbler through the door opening on the end opposite the tumbler drum drive shaft. In a large facility where meat is processed in batches of thousands of pounds, the single door type tumbler results in extreme congestion around the single door. This is caused because it is the only point at which product can be positioned in the tumbler. Carts or bins of product weighing between 400 pounds (180 kg) and 2,000 pounds (900 kg) must be lifted and poured or dumped into the tumbler drum through this single opening. The lift mechanisms, of course, are heavy and difficult to move.

The product must also be discharged through the same opening, up to 4,000 pounds (1800 kg) of product into the same 400 pound (180 kg) bins, one after another. With 30 inch (75 cm) diameter vacuum doors, the door is hinged and swung closed. Since the door is designed for a full vacuum, it is heavy and clumsy and requires a great deal of space to move into position.

At the same time, the tumbler must be provided with a means to inject liquid carbon dioxide or liquid nitrogen for chilling the product to make the formed shapes. This requires a second door to be moved into position. This door generally does not rotate with the drum as does the vacuum door as the stationary door not only contains the entry point for the liquid carbon dioxide or nitrogen, but it also contains a vent hose to vent away the cryogenic gas. Since the large vent hose must be permanently connected to the outside of the building, the vent door cannot rotate with the drum as does the vacuum door. This vent door is even more difficult to position than the vacuum door because the vent hose is attached. For cryogenic chilling, a long probe is attached to the door to reach into the drum so that nitrogen or carbon dioxide can be injected through the probe.

Nitrogen or carbon dioxide cryogenic flashes from a liquid into a gas very rapidly when it is sprayed into the atmosphere. Since the chilling efficiency is enhanced if the cryogenic nozzles are positioned close to the product during the injection and chilling processes, the probe should be long enough to reach the back of the drum where the product tumbles in the existing type drums, as disclosed in U.S. Pat. No. 5,104,232. In a production size tumbler, the nitrogen probe would have to be six to eight feet long, which is not practical since the probe must be removed after chilling each batch, two or three times per hour, to make room for connecting the vacuum door for the next batch. The longer the probe, the more difficult it is to keep it adjusted, the more room it takes up when it is retracted, and the more complicated the mechanism it requires to retract it. For these reasons, the probe has been designed quite short in existing production models, thereby reducing the efficiency of the cooling process.

One method that has been tried is to position the nitrogen injection probe on a track that moves in directly from in front of the door. In addition to being expensive, the probe mechanism takes up an enormous amount of valuable factory floor, not to mention the fact that the space is right in front of the loading and unloading area described above.

A second method is to rotate the nitrogen door and probe down from above the tumbler drum utilizing the head space above the machine. This solution improves the congestion in the critical area in the front of the door of the machine; however, the enormous mechanism required to rotate and position the probe system down from above the drum is very expensive and very difficult to keep in adjustment.

Both of the above systems result in poor efficiency and chilling with liquid nitrogen and carbon dioxide. Due to the need to keep the length of the probe short to minimize the retracted space problem, the spray nozzles end up too far from the product tumble zone. As a result, the majority of the cryogenic liquid flashes into gas rather than the droplets being sprayed onto the surface of pieces of the product and freezing onto the surface without flashing to gas.

When the cryogenic flashes to gas without making contact with the product, the gas freezes everything it contacts. The chilling efficiency is therefore reduced, creating a number of production problems, including freezing the stainless steel drum as well as the product pieces. In some instances, the product pieces will stick to the inside of the tumbler drum so that the stuck pieces remain in the drum after the product is discharged. To minimize the sticking problem, water is sprayed on the outside of the drum to keep the steel from reaching a temperature below freezing. The use of water in this way is expensive and messy, requiring expensive drainage systems and, in order to preclude wastage of water, a recirculating system. Since the purpose of the water spray is to heat up the tumbler drum to prevent it from freezing, more liquid nitrogen must be used to achieve the chilling. In those instances Where the chilling capacity of the liquid cryogenic is partially wasted on heating the steel drum by the water sprayed on the surface of the steel drum, substantially more cryogenic is required to chill the product. Since more cryogenic liquid is necessary and this liquid can only be sprayed on the product at a limited rate and still evenly coat the product pieces, it takes a longer time to chill the product. This reduces the utilization of the expensive machine, requiring more capital investment for more machines.

One of the problems with existing tumble mixers is associated with cleaning the interiors thereof. The vane system used to tumble the product is difficult to clean, with the back side of the vanes particularly hard to reach. Accordingly, in the larger tumble mixers, it is almost routine for an individual to climb inside the drum in order to perform a cleaning operation. Generally speaking, the individual carries therewith a hose or other cleaning material to accomplish the cleaning chore.

This invention overcomes the objections to the previous tumbler drums. In particular, it is an object of this invention to provide an axially-mounted, removable probe to provide material to the interior of a tumbler drum while the drum is rotating.

It is a further object of this invention to provide a probe system wherein a cryogenic liquid may be provided to the interior of a tumbler drum.

It is also an object of this invention to provide a probe system that may be used to provide product to be processed to the interior of a tumbler drum.

It is still another object of this invention to provide a probe system for a tumbler drum that can be used for cleaning.

It is also an object of this system to provide a probe system that can be utilized while the drum is rotating.

It is a further object of this invention to provide a probe system that is interchangeable so that a product supply probe can be replaced with a cryogenic probe, which in turn may be replaced with a cleaning probe.

Briefly stated, the invention comprises a tumble mixer having a rotatable drum with a horizontal axis. The rotatable drum includes a cylindrical midsection with an entry and discharge end section. The entry and discharge end section has an axial opening. The rotatable drum further includes a service access end section affixed to the rotatable drum at the end opposite the entry and discharge end section. Said service access end section is aligned axially with the rotatable drum axis. A material communication probe for providing material to the rotatable drum is also included. The service access end section defines an axially-aligned sealable entry for removably positioning the material communication probe within the cylindrical midsection whereby material can be communicated to the interior of the rotatable drum while the drum is rotating. Also included is the capability to rotate the drum by a drive member drivingly connected to the service access end.

DETAILED DESCRIPTION OF THE PREFERRED EMBODIMENT

Figure 1:
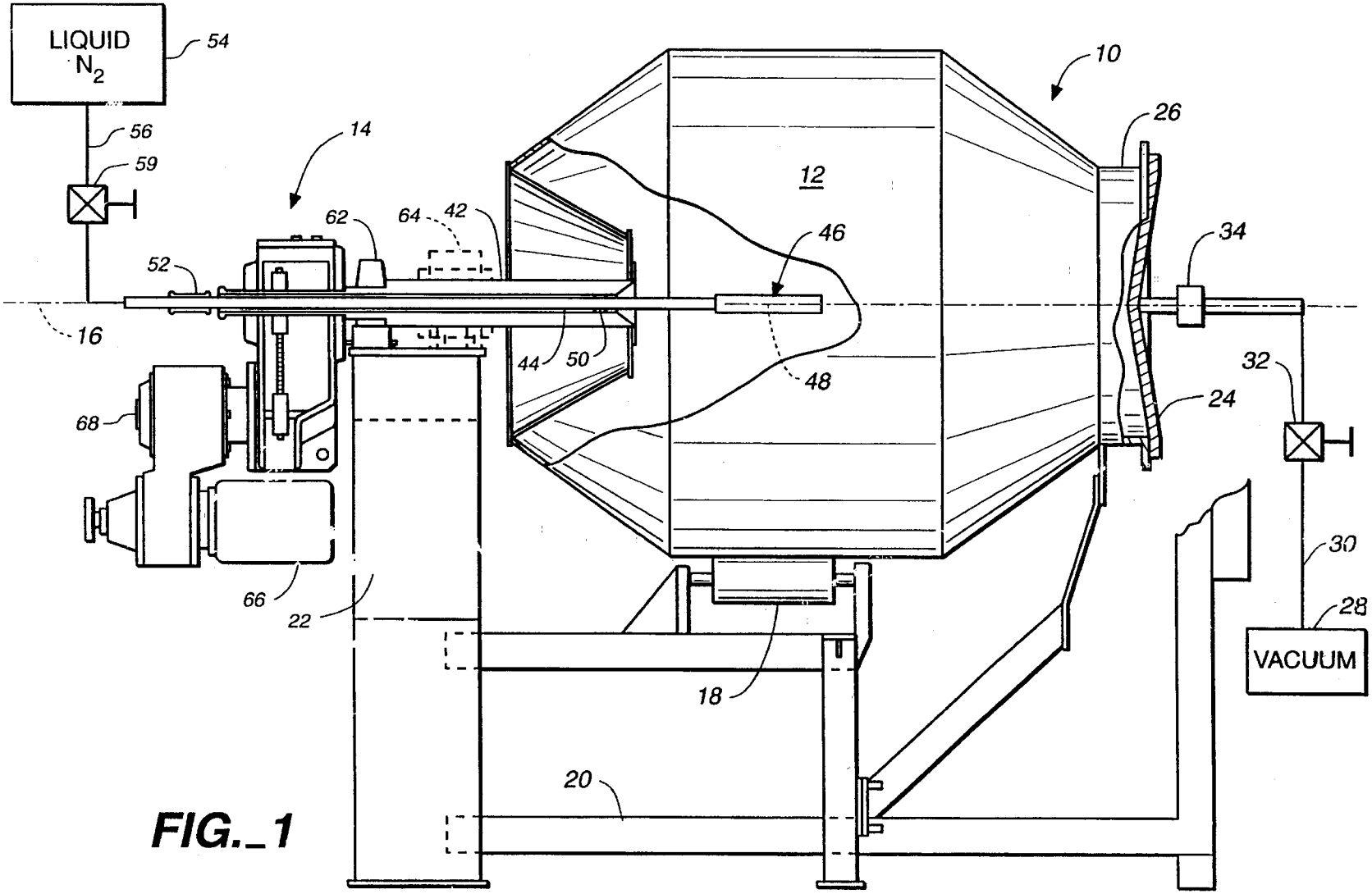
FIG. 1 is an elevation view of a tumble mixer incorporating the liquid cryogenic probe within the interior of the drum.

A tumble mixer 10 is illustrated in FIG. 1. Tumble mixer 10 includes a rotatable drum 12. In the embodiment shown in FIG. 1, tumble mixer 12 is axially supported by a drive mechanism 14 which provides the capability to rotate drum 12 about its axis 16 shown by a conventional center line. In the embodiment depicted in FIG. 1, a support roller 18 is illustrated. Support roller 18 may comprise several rollers in order to prevent undue strain on the drive mechanism. In relatively small tumble mixers, of the type used in laboratories, the support roller 18 has been found to be superfluous as the drive mechanism can be adequate to support the drum.

A frame 20 supports the entire structure, with the drive mechanism supported by an upstanding member 22.

The structure of the rotatable drum 12 is best described in U.S. Pat. No. 5,104,232, which illustrates the vane structure for moving and massaging the product that is positioned within the drum. U.S. Pat. No. 5,104,232 is incorporated herein for reference in its entirety.

In FIG. 1, a rotatable drum is shown with a sealable vacuum door 24 positioned at one end of the rotatable drum. Specifically, the vacuum door closes an entry and discharge end section wherein product may be positioned in the drum or removed from the drum. It is noted for reference purposes that this invention also includes means for introducing product through the opposite end of the drum by a probe mechanism. However, the discharge end section 26 can also be utilized for positioning product within the drum. A vacuum source 28 and conduit 30 provide means for drawing a vacuum within drum 12. In addition, an appropriate valve 32 and a swivel type joint 34 interconnect the vacuum source 28 with the vacuum door 24. Swivel joint 34 permits rotation of drum 12 while a vacuum is being maintained in the drum. Vacuum door 24 may be positioned on hinges (not shown), or may simply be a removable member that can be stored at another site during the loading and cooling processes of this drum.

Figure 2:
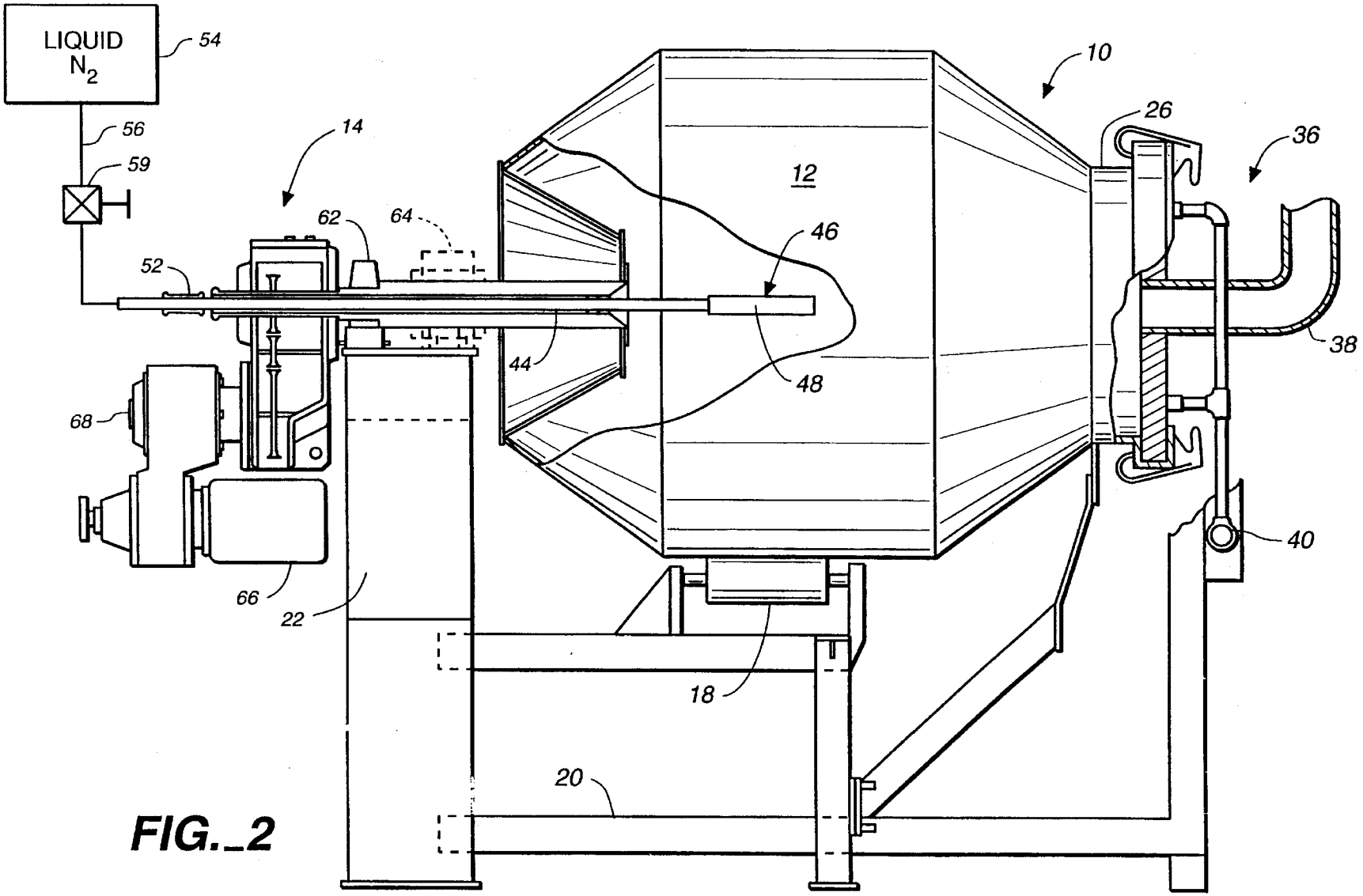
FIG. 2 is the same tumble mixer with the liquid probe inserted therein, along with the vent door.

Referring to FIG. 2, the same tumble mixer 10 is illustrated, but in this instance with a vent door 36 positioned at the entry and discharge end section 26. Vent door 36 includes a vent 38 which is connected to a flexible conduit (not shown) that will vent the gaseous contents of rotatable drum 12 to the atmosphere. Preferably, the vent system vents the cryogenic gases used in cooling (to be described) to the outside of the building which contains the tumble mixer. Vent door 36 as described in U.S. Pat. No. 5,104,232, does not rotate with drum 12, but rather remains stationary. While positioned on hinges 40, it can also be completely removable.

It is pointed out that vacuum door 24 does rotate with the drum and the rotation is taken up by the swivel 34 so that conduit 30 does not rotate with the drum.

Having described the essential points of previous tumble mixers, it is appropriate to point out at this stage that in the present devices, entry and discharge of material is performed through entry and discharge end section 26. Generally speaking, this is performed by either a loading chute (not shown) or by hand loading with shovels and the like.

The invention herein lies at the opposite end of tumble mixer 10. Specifically, drive axle 42 is hollow, defining a hole 44 through its entire length. Through hole 44, a probe for providing material such as cryogenic or nitrogen probe 46 may be introduced to the interior of the drum 12, which is shown broken away in FIGS. 1 and 2. Nitrogen probe 46 is supported at the end closest the nozzle 48 by a guide bushing 50. At its opposite end, probe 46 includes a sanitary rotary joint 52 that interconnects with the hollow shaft or axle 42. Thus, probe 46 is supported at both ends within the hollow shaft or axle 42. A liquid cryogenic source 54, preferably nitrogen, is provided with this invention, along with a conduit 56 which includes a flexible coupling. Appropriate valving 59 is provided to control the flow of liquid nitrogen through probe 46 and nozzle 48 to the interior of tumble mixer 10.

Nozzle 48 is configured so that liquid nitrogen or whatever cryogenic material is used is generally directed to the rear of the rotatable drum 12, the rear being to the left as seen in FIG. 1.

Figure 5:
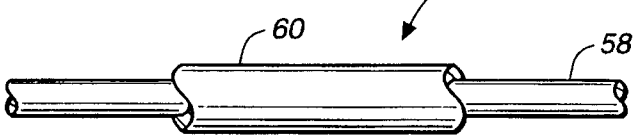
FIG. 5 is a partial view of the double walled vacuum tube for the cryogenic probe.

Referring now to FIG. 5, probe 46 is vacuum jacketed, that is, there is an internal hollow tube 58 that is mounted within an outer cylindrical member 60 which is sealed at one end to nozzle 48 and sealed at the other end to the sanitary rotary joint 52. The tube 58, of course, runs from the sanitary rotary joint 52 (available from Thomsen in Kenosha, Wis.) through to the nozzle 48. A vacuum is permanently established between the inner tube 58 and the outer jacket 60 so that liquid nitrogen which is passed through tube 58 does not flash into a gaseous state until it is released from nozzle 48.

Hollow shaft 42 is supported on upstanding member 22 by two shaft support bearings 62 and 64.

Drive mechanism 14 preferably includes a motor 66 and a gear box 68 which has a reversing capability. The drive from gear box to hollow shaft 42 is conventional in nature and can be either a direct geared connection (shown schematically in FIG. 2) or, in larger installation, a chain and sprocket connection (shown schematically in FIG. 1).

Figure 3:
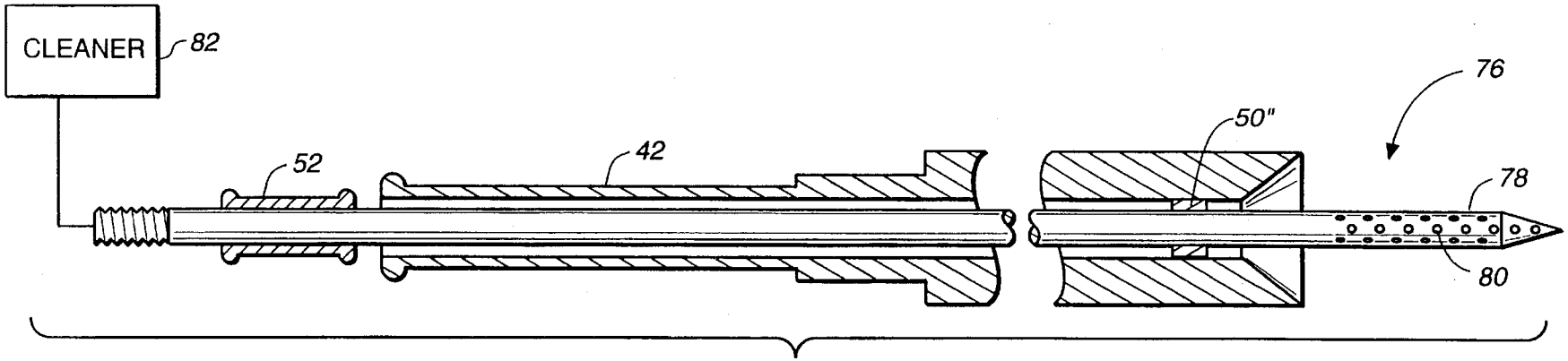
FIG. 3 is a sectional view of a probe used to insert cleaner into the tumble mixer.
Figure 4:
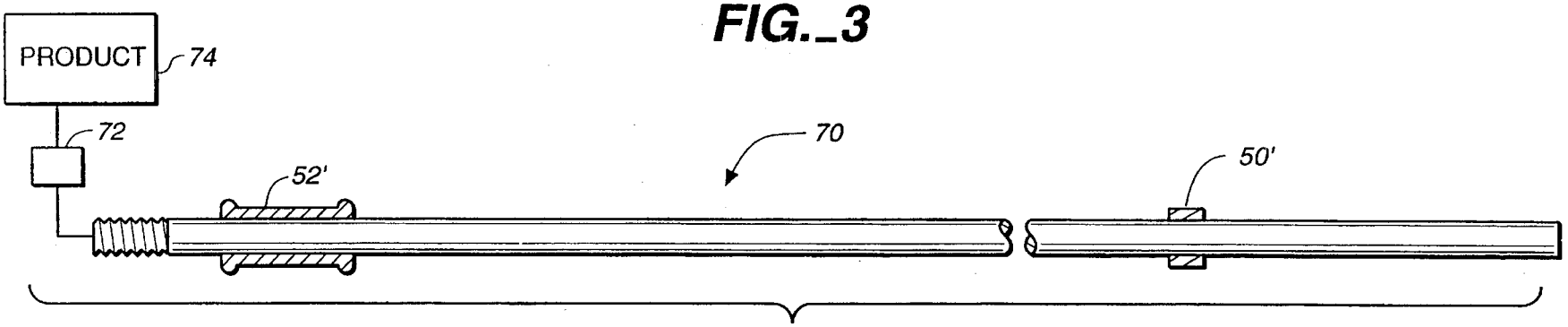
FIG. 4 is a sectional view of a probe utilized to insert product into the rotating drum.

Referring to FIGS. 3 and 4, two alternative probes for providing material to drum 12 are shown which are used in conjunction with nitrogen probe 46. First, in FIG. 4, a product probe is illustrated. In most instances, the product associated with this tumble mixer will be a meat product such as beef, chicken, pork or the like, which is mixed in rotatable drum 12 with a marinade, i.e., seasoning. Thus, probe 70, through which chopped meat or poultry is transported, could include a feed screw 72 type device which, in a manner of a conventional helical feed mechanism, will force the product through probe 70. A product source 74 may be loaded in any manner convenient to the user. It is pointed out that produce probe 70 includes a guide bushing 50' and a sanitary rotary joint 52' in a manner similar to the nitrogen probe described above. Thus, the product probe as shown in FIG. 4, with the removal of the nitrogen probe from the hollow shaft, may simply be inserted through hollow shaft 42 and product fed into the drum. Once the product is in the drum, the product probe may be withdrawn and the nitrogen probe replaced for appropriate use to be described.

Also included in the invention is a third material probe in the form of cleaning probe 76 which is also configured in a manner similar to the nitrogen probe. In FIG. 3, cleaning probe 76 has at one end a nozzle 78 that includes a plurality of holes 80 that would spray a cleaner around the interior of rotating drum 12. Cleaning probe 76 also includes the guide bushing 50" and the sanitary joint 52". Thus, it is in effect a duplicate of the nitrogen probe, except that it is provided with a source of cleaner 82 which may include hot water and some cleaning solution.

Both product probe 70 and cleaner probe 76, along with the nitrogen probe 46, are sufficiently lightweight so that they may be readily removed from hollow shaft 42 and replaced one with another without undue difficulty, nor do they take up sufficient space to hinder the operation of the tumble mixer.

Operation of the tumble mixer should be apparent to those skilled in the art; however, the following description is provided for convenience's sake. Should the user elect to load the tumble mixer 12 through the probe 70, then the probe 70 is first inserted into the hollow shaft 42 and product is forced therethrough by feed screw 72 or the like. Alternatively, product may be loaded into the tumble mixer through entry and discharge end section 26, which has been the procedure in the prior art devices.

Once the product is loaded, the product probe 70 is withdrawn and the nitrogen probe 46 is inserted through the hollow shaft 42. Initially, vacuum door 24 closes the entry and discharge end section 26 in the conventional manner and a vacuum is drawn within the rotatable drum 12 by means of the vacuum pump 28. Once sufficient vacuum is drawn on the rotatable drum 12, rotation of the drum can commence. The purpose of the vacuum, as is well known in the art, is to permit the marinade which is placed with the product in the drum to penetrate the pores of the product, be it meat or poultry or the like. During this phase of the operation, the drum is rotated with the vacuum pump 28 still maintaining a vacuum within the drum. After a sufficient period of time, the massaging and marinating of the meat has been accomplished and the drum may be stopped so that vacuum door 24 can be replaced with vent door 36 as shown in FIG. 2. With vent door 36 in position, the rotation starts again of the rotatable drum 12 and the cryogenic liquid, preferably liquid nitrogen but alternatively liquid carbon dioxide, is passed through nitrogen probe 46 into the interior of rotatable drum 12. The rotatable drum 12, having vanes in the manner of that described in U.S. Pat. No. 5,104,232, will cause the product to accumulate at the drive end or left end of the drum as shown in FIG. 1. The liquid nitrogen is directed generally at that direction, with the probe being positioned toward the left end of the drum, that is, away from the entry and discharge end section. Rotation of the rotatable drum 12 continues until the temperature of the product contained therein reaches the desired point, at which time rotation stops. During the chilling portion, that is, the portion of the time while liquid nitrogen is being applied to the interior of the drum, the gaseous nitrogen which of course accumulates within the drum is vented by means of vent 38 to the atmosphere.

Once the chilling is complete, the vent door 36 can be removed and, by reversing the drum, the veins described in U.S. Pat. No. 5,104,232, will force the product out through the entry and discharge end section 26 into appropriate loading and unloading carts.

At this point, cleaning may take place in between cycles by removing the nitrogen probe and replacing it with the cleaner probe 76 as shown in FIG. 3. Alternatively, the nitrogen probe can be withdrawn and, without cleaning the product, probe 70 can be inserted in its place for the insertion of additional product and the beginning of a second cycle.

Most significantly, there is a distinct reduction in time for chilling product and the reduction of the amount of liquid cryogenic material required to chill a batch of product. Tests have indicated that the time for chilling is reduced by 30 to 35 percent over the existing systems, and the savings in cryogenic is from seven to 12 percent. Further, since the cryogenic is sprayed directly onto the product, less cryogenic is required to chill a product and the stainless drum does not freeze up so that no water is required to keep the drum warm. Without water, very little product freezes to the inside of the drum.

Finally, in using the cleaning probe, it has been found that the back sides of the tumbler vanes (not shown) could not be cleaned with the conventional spray through the single door, that is, the front opening device in the prior art. This therefore necessitated a worker climbing inside the drum to clean the backs of the tumbler vanes. Not only does the instant invention reduce Labor costs, it is infinitely better from a safety standpoint.

While this invention has been described with some particularity in the specification, it is to be considered limited only by the appended claims.

What is claimed is:

1. A tumble mixer comprising:

a sealable rotatable drum having a horizontal axis, a cylindrical mid-section and an entry and discharge end section affixed to said rotatable drum at one end thereof, said entry and discharge end section having an axial opening, said rotatable drum further having a service access end section affixed to said rotatable drum at the end opposite said entry and discharge end section, said service access end section aligned axially with said rotatable drum axis, drive means drivingly connected to said service access end for rotating said drum, material communication means for providing material to said rotatable drum, said service access end section defining axially-aligned sealable entry means for removably positioning said material communication means within said cylindrical mid-section, whereby material can be communicated to the interior of said rotatable drum while said drum is rotating, said material communication means comprising a removable elongated probe having a first and a second end and a nozzle means, a material source, said nozzle means affixed to said first end of said elongated probe for directing material communicated thereto from said material source to predetermined areas of the interior of said rotatable drum, a sanitary rotary joint for detachably connecting said material source to said second end of said elongated probe, a frame said rotatable drum mounted on said frame at its service access end, said drive means including an axle defining a bore therethrough, said bore communicating with the interior of said rotatable drum and having a first end interior of said rotatable drum and a second end exterior of said rotatable drum, whereby said material communication means can be removably inserted in said bore so that said nozzle means is within said drum and said second end of the removable elongated probe extends out the second end of said bore.

2. The tumble mixer of claim 1 wherein said material source is liquid nitrogen.

3. The tumble mixer of claim 2 wherein said sealable entry means includes a sanitary rotary seal formed to abut said elongated probe while said probe is positioned in said rotatable drum.

4. The tumble mixer of claim 2 further including vent means for venting nitrogen.

5. The tumble mixer of claim 1 further including a sealable vacuum door closing said axial opening of said entry and discharge end section, said sealable door including a vacuum port.

6. The tumble mixer of claim 5 further including an alternative door closing said axial opening of said entry and discharge end section when said sealable door is not used, said alternative door including an exhaust port.

7. The tumble mixer of claim 5 further including vacuum pump means for drawing a vacuum, and conduit means for connecting said vacuum pump with said vacuum port.

8. The tumble mixer of claim 1 wherein said drive means for rotating said drum includes a motor mounted on said frame, a driving member axially affixed to said rotatable drum of said service access end and connecting means for connecting said motor to said driving member.

9. The tumble mixer of claim 8 wherein said driving member is a ring gear affixed to said rotatable drum and said connecting means is at least one gear for driving said ring gear.

10. The tumble mixer of claim 8 wherein said driving member is a first sprocket affixed to said rotatable drum, said connecting means is a second sprocket affixed to said motor and a drive chain for interconnecting said second sprocket with said first sprocket.

11. The tumble mixer of claim 1 wherein said drive means is reversible for rotating said drum in opposite directions.

12. The tumble mixer of claim 1 wherein said material source is a cleaning solution.

13. The tumble mixer of claim 1 wherein said material source is ground food.

14. The tumble mixer of claim 13 wherein said ground food is comprised of meat.

* * * * *